United States Patent [19]

Eberhardt et al.

[11] Patent Number: 4,691,667

[45] Date of Patent: Sep. 8, 1987

[54] GASOLINE ENGINE EMI SUPPRESSION SYSTEM

[75] Inventors: H. Alfred Eberhardt, Paoli; Kalman Broitman, Dresher; Richard A. Evangelista, Downingtown; Richard E. Teske, Norristown; Michael Sulmone, King of Prussia, all of Pa.

[73] Assignee: Hale Fire Pump Company, Conshohocken, Pa.

[21] Appl. No.: 841,277

[22] Filed: Mar. 19, 1986

[51] Int. Cl.[4] ..... F02P 11/00

[52] U.S. Cl. ..... 123/633; 123/599; 123/143 C

[58] Field of Search ..... 123/633, 635, 143 C, 123/599, 596; 200/19 D, 14 C, 304

[56] References Cited

U.S. PATENT DOCUMENTS

| | | | |
|---|---|---|---|
| 1,837,255 | 12/1931 | Du Pont et al. | 123/143 C |
| 2,462,489 | 2/1949 | Hallatt | 123/633 |
| 3,293,352 | 12/1966 | Livingston | 123/633 |
| 3,965,879 | 6/1976 | Fitzner | 123/633 |
| 4,078,534 | 3/1978 | Mayor | 123/633 |
| 4,491,121 | 1/1985 | Miura et al. | 123/599 |
| 4,494,520 | 1/1985 | Hurwitz | 123/633 |

*Primary Examiner*—Raymond A. Nelli

*Attorney, Agent, or Firm*—Eugene E. Renz, Jr.

[57] ABSTRACT

A spark ignition engine device adapted for use with a pump. The engine is mounted on a mounting structure. The engine has a magneto flywheel for generating an ignition current and a high-voltage ignition coil means electrically connected by a first conductive wire means to the magneto. A conductive shield covers the first wire means and is grounded. The spark plugs are electrically connected by a second conductive wires means to the coil to deliver a high-voltage spark to the engine. The second wire means is also covered by a conductive shield covering and the shield is grounded. A control box is provided and grounded to the mounting structure. The control box is positioned to enclose the coil means and to receive the shielded first wire means. The box has a capacitor means grounded to the box and connected to said shielded first wires to prevent reverse flow of EMI to the magneto.

6 Claims, 6 Drawing Figures

GASOLINE ENGINE EMI SUPPRESSION SYSTEM

FIELD OF THE INVENTION

This invention relates to gasoline engines and other spark ignition engines, and particularly to engines which are used in combination with pumps such as water pumps. The invention relates particularly to that class of water pumps which are driven by gasoline engines and are mounted on portable mounting structures and placed on board ships and other maritime vessels such as navel, military and commercial vessels such as scientific, exploratory, freight carrying and passenger ships. These pumps are placed on board various ships as fire-fighting equipment and are designed to pump water in large volumes with significant pressure to extinguish fires which might occur on board the ship.

Fire-fighting water pumps driven by spark ignition engines are of particular importance on board navy vessels which have the potential of being exposed to explosive or incendiary materials. Many naval vessels including aircraft carriers and other ships are exposed to high-intensity energy from jet aircraft. Other vessels store flammable and explosive materials which can be accidentally ignited or detonated from sparks or other causes.

These same navy vessels are ever increasingly becoming loaded with electronic circuitry for computers, and many other sophisticated devices for many and varied purposes. Most of this electronic equipment is sensitive and in some cases highly sensitive to random or unwanted electromagnetic interference. Important measurements and calculations can be distorted or delayed if electromagnetic interference is present in the vicinity of the electronics beyond certain specified limits. This interference, hereinafter known as EMI, is unwanted and it is an advantage to reduce it as much as possible, although absolute elimination may not be possible. Any equipment which is brought on board ships of this type must be shielded or otherwise controlled so that it does not create and/or transmit unwanted EMI. In most instances, equipment can be placed in strategic locations which permit shielding or otherwise controlling the amount of EMI which is emitted. In fire-fighting equipment particularly, however, it is not always possible to place the pump, for example, in a safe place where unwanted EMI would not adversely affect nearby electronics. Because of the portable nature of these pumps, they must be suitable for operation at essentially any place on board the ship. Accordingly, the minimization of EMI generated by these spark iginition-powered pumps would substantially increase their versatility and adaptability to operation on board ships, particularly ships which contain complicated and sensitive electronics.

BACKGROUND OF THE INVENTION

Various causes of unwanted EMI have been noted and attempts have been made to eliminate such disturbances. U.S. Pat. No. 4,453,526 and its companion, U.S. Pat. No. 4,527,535 both recognize that magnetic fluxes leak from ignition coils and that this leakage can cause erroneous operation or malfunction of equipment such as integrated ignition coils and amplifier combinations.

U.S. Pat. No. 4,380,225 seeks to protect the ignition system of internal combustion engines against electrical and magnetic interference. In this patent, the solution includes the use of light guide "pipe" photoconductors which are in some instances included in the cable harness of the vehicle.

U.S. Pat. No. 4,463,224 relates to the suppression of electromagnetic waves radiating from the discharge between a distributing electrode and side terminal electrode. The solution for this patent includes the use of silicon carbide ceramics and other electromagnetic wave absorbing material. Primarily, the material is mixed appropriately with the distributor cap or applied thereon.

Finally, U.S. Pat. No. 4,186,712 is specifically drawn to the elmination of radio frequency interference from gasoline engines which have capacitor discharge ignition systems. This solution disclosed in this patent includes the use of special spark plugs and a low-resistance, low-inductance suppression element.

All of these patents recognize that EMI may be eliminated, at least in part, when the source of EMI is shielded or when the interference is absorbed into specifically provided elements. Shielding of wires which transmit high-voltage current is, of course, one method for eliminating EMI from a device. Conductive shields such as braided wire may be used to surround wires and effectively reduce EMI, as long as the braided wire shields themselves are properly grounded. Proper grounding of any type is useful in reducing EMI. Even where proper shielding is used, if grounding is not adequate, the EMI will escape and potentially disrupt suitability of the operation of the device.

In specific devices which are portable, such as the above-described gasoline engine powered, portable fire pumps, shielding the spark plug and the ignition wires has been found to reduce somewhat the amount of EMI present during operation. Nevertheless, such steps of shielding the spark plug and the ignition wires is not adequate to reduce the EMI to a level which would permit the use of electronics. Heretofore, it has only been possible to effectively reduce EMI from portable spark ignition-powered pumps when low energy ignition systems are employed. When high energy ignition systems are used with higher voltages than have been employed in the past for pumps of this type, the resultant electric fields are, therefore, also more intense. Ignition systems of over 40,000 volts with extremely rapid rise time are contemplated. Shielding is far more difficult, and has not been possible using the individual methods known previously.

SUMMARY OF THE INVENTION

It has now been discovered that spark ignition engine devices which are adapted for use with water pumps and which are mounted on mounting structures can be improved so as to substantially reduce unwanted EMI to a level which can be tolerated. Engines having a magneto flywheel for generating an ignition current, a high-voltage ignition coil means electrically connected by a first conductive wire means to the magneto, and at least one spark plug electrically connected by a second conductive wire means to the coil to deliver a high-voltage spark, may be improved in the following manner. Specifically, a conductive shield is provided for covering the first wire means. A control box grounded to the mounting structure and positioned to enclose the coil means is provided, and adapted to receive the shielded first wire means. The shielding on the first wire means is grounded to the box which, in turn, is grounded to the mounting structure. The box has a capactitor means also grounded to the box and connected to the shielded wires to prevent reverse flow of EMI to the magneto. This capacitor means allows flow-through of the generated ignition current but does not permit re-radiation of EMI back to the magneto. Finally, a conductive shield is provided to cover the second wire means from the spark plug to the coil. Again, the shield is grounded to the control box which, in turn, is grounded to the mounting structure. The mounting structure itself sits on the deck of the vessel without physical ground. Because of the relationship of the mounting structure to earth, a capacitive coupling is achieved.

In a preferred embodiment, the control box has one major ground connected to the ground mounting structure. The control box is assembled from metal and is fastened together without the use of sheet metal screws. Every metal-to-metal contact at every ground location is cleaned to bare metal using rotary action prior to completion of the connection. In those instances where the metal is aluminum, conventional treatment of the surface of the aluminum to render it both conductive and corrosion resistant is done. Processes known as Alodine treatment or Iridite treatment for aluminum surfaces are employed.

When adequate shielding and grounding is provided, as is contemplated as part of the present invention, significant reduction in EMI is achieved so as to permit use of engine pump combinations in highly sensitive areas, particularly on board ships.

A significant contribution of the present invention is the recognition that the entire device may be acting as a source of unwanted EMI. Steps are taken to eliminate EMI by methods and devices which go beyond mere attention solely to the ignition system.

BRIEF DESCRIPTION OF THE DRAWINGS

These and other objects of the present invention and the various features and details of the operation and construction thereof are hereinafter more fully set forth with reference to the accompanying drawings, wherein.

DETAILED DESCRIPTION OF THE PREFERRED EMBODIMENT

Figure 1:
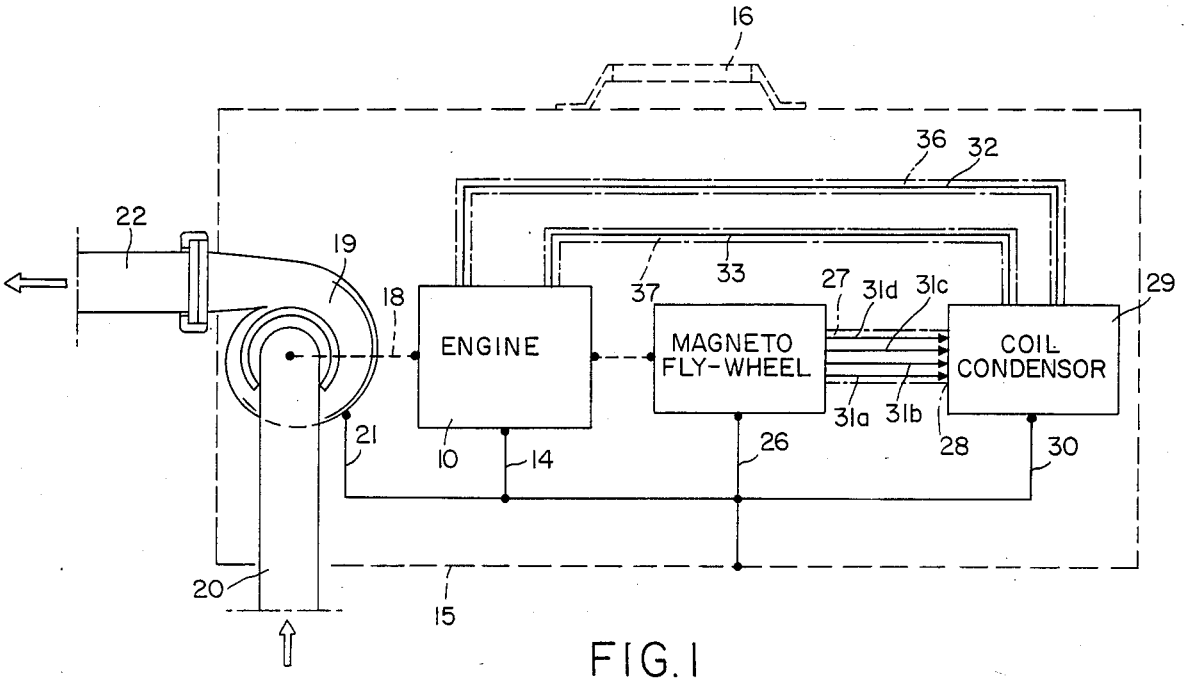
FIG. 1 is a schematic diagram of an actual operating device according to the principles of this invention.

Referring now to FIG. 1, a schematic diagram is presented of an actual embodiment of the present invention. The specific embodiment depicted in this schematic is a two-cycle, two-cylinder spark ignition powered engine and high-pressure water pump mounted on a mounting structure. The device is portable and can be moved to various locations on board ships for the purpose of providing a high-velocity stream of water for fire control and other purposes. The specific engine may operate on gasoline, kerosene, propane, or other fuels.

The engine 10 is started with a pull starter 12. The engine 10 is mounted by a conductive support 14 to the mounting structure 15. The mounting structure may be portably moved by handle 16. The mounting structure 15 rests on the deck of the ship and has a capacitive coupling thereto. By mechanical linkage 18, the engine 10 drives pump 19 so that water is taken in through input 20 and discharged through discharge 21, such as through a fire hose and nozzle or whatever. The engine is normally a high-performance engine, because the weight of the unit is a limiting factor in its portability and yet power is necessary not only to provide a high-ressure discharge but also to be capable of high lift operation. The pump 19 is also supported by a conductive attachment.

The engine 10 is of conventional design and uses a magneto flywheel 25 which is connected by mechanical linkage 24 and is mounted by schematic support 26. As the magneto flywheel rotates, it generates an ignition current which passes through first conductive wire means 27 into the coil assembly including a power pack, coil and other conventional high energy components. Line 27 is adapted to insert into connector 28 which passes the ignition current into the coil condensor control box 29. The coil condensor 29 is supported on a conductive support 30 which again is attached to mounting structure 15. In the particular embodiment shown, there are four conductive wires contained in the first wire means 27 as will be hereinafter described.

Figure 2:
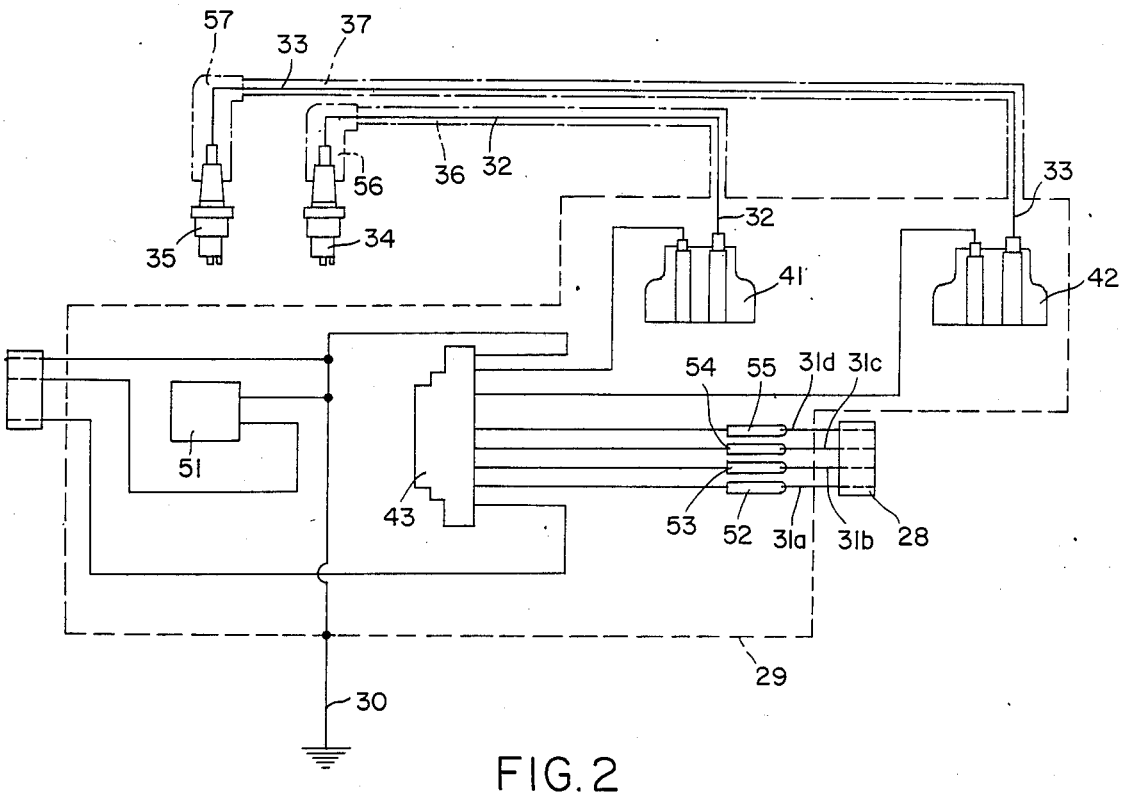
FIG. 2 is an electrical wiring drawing in partial schematic of the components contained in the control box housing, as outlined in the dotted lines.

The coil is connected to the spark plugs of the engine by a second conductive wire means. A second wire 32 travels to the upper spark plug 34, as schematically shown in FIG. 2, while the second wire means also includes a wire 33 which conducts high-voltage current to the lower spark plug 35. Second wire 32 is covered with a braided shield wire 36 from the coil box 29 to the spark plug 34. Similarly, the second wire 33 is covered by a braided shield 37 from the control box 29 to the lower spark plug 35. Both wires 32, 33 may be regular high tension leads or they may be resistance high tension wires. The latter are preferred.

As shown schematically in FIG. 2, the plug 28 receives an ignition current from the first wire means 27 which introduces four wires 31*a*, 31*b*, 31*c*, 31*d* into the control box 29. Each of these wires from the plug 28 pass through individual feed through capacitors 52, 53, 54, 55 so that EMI generated by the magneto flywheel and conducted through first wire means 27 will be captured by the capacitors and a reverse flow back to the magneto is prevented. Also, EMI generated inside the control box cannot escape back to the magneto. Thus, the first wire means 27 carries unwanted EMI into the capacitors but does not permit re-radiation of the EMI through the wire 27 and the magneto flywheel 25.

Once the ignition current passes through the capacitors 52, 53, 54, 55 it is, in conventional two-cycle, high-voltage gasoline engine technology, enhanced through a power pack 43 and transmitted to the top ignition coil 41 and the left side ignition coil 42. Top coil 41 then produces a current through line 32 to spark plug 34 and a high-voltage spark is provided. Similarly, left side coil 42 provides a current carried by line 33 to lower spark plug 35 in a similar manner.

Figure 3:
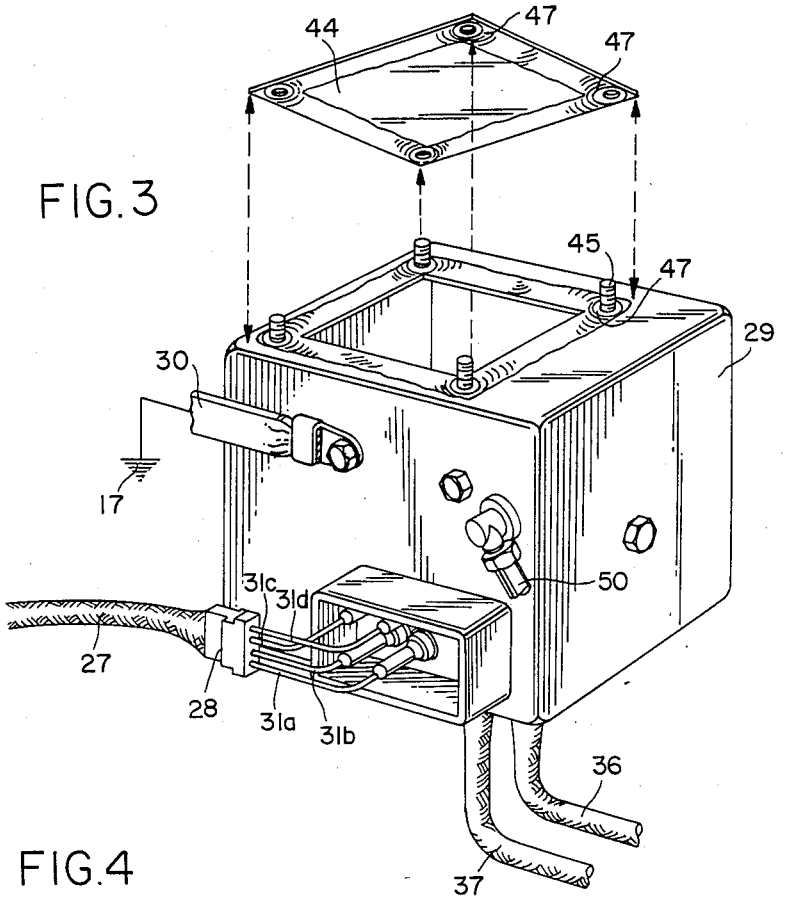
FIG. 3 is a perspective view of the control box illustrating the physical appearance and assorted parts of one embodiment of this invention.

The control box 29 which encloses the coils 41 and 42 is shown in perspective view in FIG. 3. The braided wire means 27 from the magneto plugs into plug 28 and individual wires 31*a*, 31*b*, 31*c*, 31*d* enter into the control box 29. Departing from the bottom of the control box 29 are covered or braided shields 36, 37 which contain the wires 32, 33 leading to the spark plugs. The box 29 is connected to support 30.

For access to the control box 29, any number of sides can be removable. However, when they are removable, care must be taken to prevent sources of unwanted EMI from being built into the system. A face 44 is provided in FIG. 3 for cooperative closing of control box 29. The top face 44 fits over bolts 45 which extend up from the control box 29 and are matched with nuts 46 for appropriate fastening of the top face 44. Because of the dangers of breaking an adequate ground, each of the places where nut 46 and bolt 45 are used are first polished to bare metal in a swirling manner as shown by the reference numeral 47. It has been found that a swirling action such as shown by reference 47 cleaning the surface down to bare metal permits a strong electrical contact to be made, wherein grounding will not be interrupted. The swirling prevents the intrusion of salt or dust or other contaminants from entering into the area between the top of the box 29 and the bottom of the face 44. A metal-to-metal seal is obtained so that a total periphery of metal-to-metal seal is achieved. When aluminum is used, the previously mentioned surface treatment such as those known as Alodine and Iridite processes is used. As shown in FIG. 3, box edge 48 and face edge 49 are polished to bare metal and are in firm grounding conducting contact with each other when the face 44 is attached by bolts 45 and nuts 46 to the control box 29.

Figure 4:
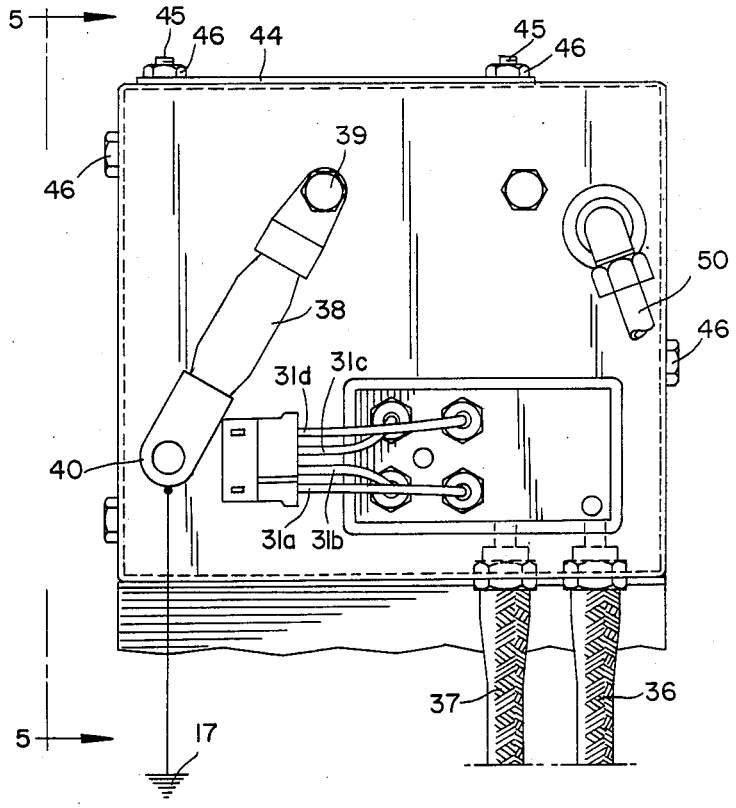
FIG. 4 is a back elevational view of the control box shown in FIG. 3.

As shown in FIG. 4, the plug 28 transmits the four wires 31*a*, 31*b*, 31*c*, 31*d* into the interior of control box 29. All of the EMI which is to be dissipated from control box 29 is preferably withdrawn through a common ground or one major ground. In this case, bolt 39 is connected to the one face 29*a* of control box 29 so that connector 38 can be attached via the fitting 40 to a line going to the engine block. It has been found that secondary EMI is generated if all of the electromagnetic inteference is not taken to ground such as through a bolt 39 and connector 38.

Figure 5:
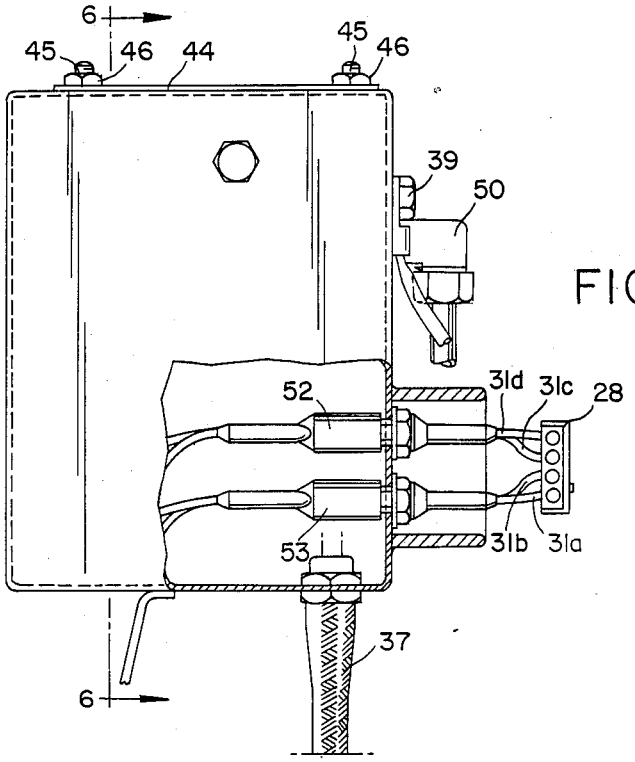
FIG. 5 is an elevational view of the control box as viewed from the right-hand side of the control box and designated by the line 5—5 of FIG. 4.

As shown in FIG. 5, the four capacitors receive the wires 31*a*, 31*b*, 31*c*, 31*d* from the plug 28 and first wire means 27. The wire means 27 is firmly bonded to the plug 28 and all EMI carried by the first wire means 27 is brought through capacitor 52 or 53, for example, and are not regenerated.

Figure 6:
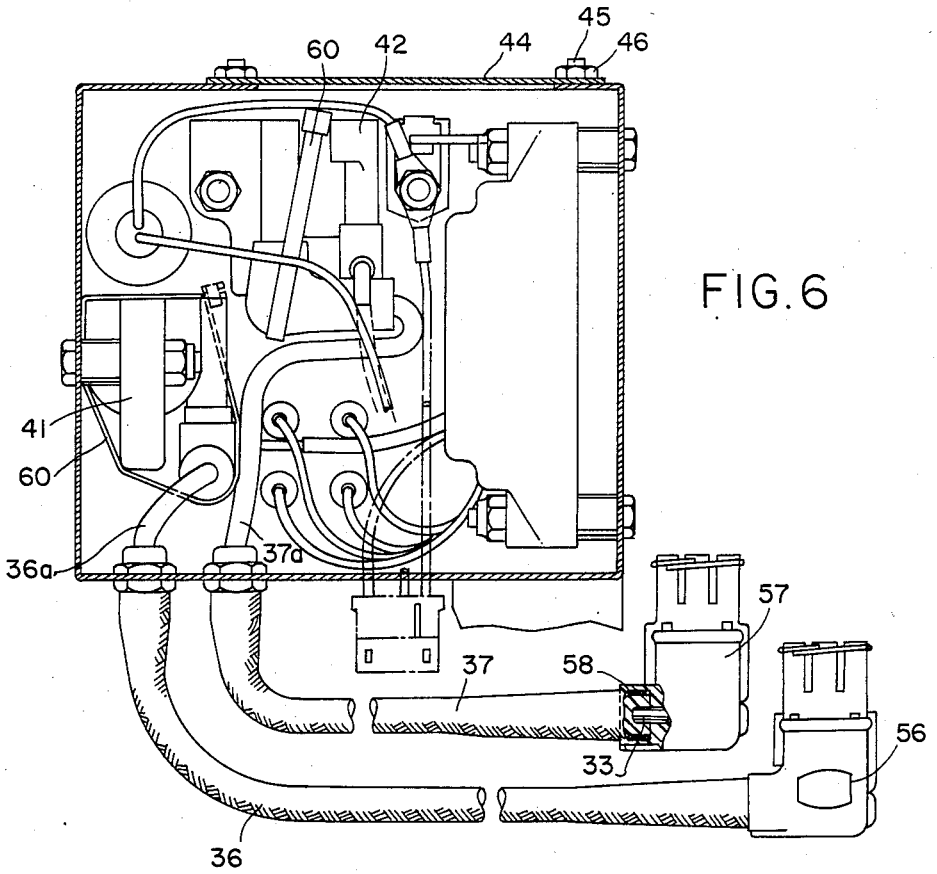
FIG. 6 is a sectional elevational view taken along the line 6—6 of FIG. 5.

Actual connection to the engine spark plugs 34, 35 is made through spark plug caps 56, 57. As shown in FIG. 6, spark plug cap 57 is adapted to fit onto the braided wire 37 which carries conductive wire 33 from coil 42. Bonding element 58 makes sure that the grounding of EMI through the braided wire 37 is accomplished directly into the engine 10 through the spark plug cap 57. Engine 10, it is remembered, is grounded to the mounting structure. High tension leads 36*a*, 37*a* also are supported by straps 60, 61 respectively to reduce vibration and potential generation of EMI due to intermittent connections.

As was stated earlier herein, a significant contribution of the present invention is the recognition that the entire device may be acting as a source of unwanted EMI or as a transmitter or antenna for unwanted EMI. Therefore, steps are taken to eliminate EMI by steps which go beyond mere attention solely to the ignition system.

As has been shown, the control box is assembled using nuts and bolts for assembly. The use of sheet metal screws is to be totally avoided. Sheet metal screws oftentimes cause small metallic chips to fall off the metal to which they are attached. These little metal chips will bounce around in the interior of the control box, for example, and generate unwanted EMI. Noticeably performance improvements are obtained when sheet metal screws are avoided.

Similarly, wherever a metal-to-metal contact is made, rotary or other vigorous polishing to bare metal should be done prior to assembly. Again, where aluminum is used, surface treatment is needed. For example, in the throttle linkage, filler washers and bowed washers should be used at every bolt so that a strong metal-to-metal contact is made. Thus, vibrations which cause unwanted EMI are avoided. Similarly, in the starter assembly for starter 12 of engine 10, grease on each part reduce any metal-to-metal contact and rubbing and therefore, additionally preventing unwanted EMI from being generated.

Of course, when any connection is made and the metal is bared so that a proper connection or ground is achieved, varnish or paint or other preventitives are to be applied after connection is made to prevent corrosion and contamination from destroying the junction and therefore reducing or destroying the ground.

Points of grounding for a completed device which generates little or no EMI are important. The underneath flywheel and magneto area cannot be effectively shielded because of the nature of the unit, and other means must be used as described herein. For example, the use of the braided wire 27 from the flywheel magneto to the control box effectively draws most if not all of the EMI into the control box. The capacitors in the control box prevent the wire means 27 from acting as an antenna, sending EMI back to the unshielded magneto flywheel. The feed-through capacitors are, as shown previously, grounded and do not permit remission of unwanted EMI.

The control box itself acts to dissipate almost all of the EMI which is generated. Therefore, it is necessary for a single major ground to be used, so that the unwanted EMI is harmlessly passed onto the ground. Care should be taken to ensure that every bolt is grounded to the box itself to prevent the bolt head from acting as an antenna.

Other methods may be employed to "supertune" the device, such as, when appropriate, packing the air cleaner screen with a plastic seal to prevent metal-plastic vibrating or rubbing. Also, the gauges may be damped with silicone or other means to prevent metal-to-metal contact during vibration. Also, when the capacitors are connected to the incoming braided wire, a relatively elongated path from the casing to the wire is provided so as to eliminate the possibility of shorts caused by corrosion or dirt. These problems cause arcing and thus EMI radiation.

In the present embodiment, one braided wire covering 27 has been shown, and this is often adequate to reduce EMI. In extremely sensitive situations, or where the engine spark voltage is extremely high, multiple braided coverings can be used. Also useful is a device known as a Lossy Sleeve, such as those manufactured by the Capcon Co. which are commercially available rubber sleeves which contain materials to assist dissipation through the braid.

When clocks and other measuring or metering devices are used in combination with the engine and pump of this invention, as is most always necessary, care must be taken to prevent EMI effects because of their use. In one preferred embodiment, the clock, for example, is mounted in rubber and is supported by a metal clamp. The casing or cover of the box into which the clock is placed, fits into the rubber ring as it in turn is supported by the clamp. The clock is positively grounded to the control box into which it fits, and the bracket itself is also connected to the ground. When steel and aluminum are contacted, such as when the box and the clock are fabricated from different metal, extra care must be taken to ensure positive grounding between the two metals. Polishing or surface treatment as previously described should be used to ensure adequate grounding.

As can be seen a number of individual steps are taken to avoid the generation of unwanted EMI, and thereby to permit the use of high-energy gasoline powered water pumps in an environment of delicaate and complicated electronics. Tests have been performed on prototype designs in which all of the unwanted EMI is eliminated from operating pumping units. Even at full throttle, when transmitting large volumes of water under high pressure, the reduction in EMI is significant enough to comply with the requirements of all of the most sensitive electronic equipment carried on board naval vessels.

What is claimed is:

1. A spark ignition engine device adapted for use with an internal combustion engine driving an accessory such as a pump in an EMI radiation sensitive environment and mounted in a mounting structure, comprising:

an engine having a magneto flywheel supported thereon for generating an ignition current;

first wire means for transmitting ignition current from said magneto flywheel including a plurality of wires carrying said ignition current and radiated EMI from said magneto and a first conductive shield means covering said wires, said first wire means inherently acting as an EMI emitting antenna, said shield being grounded to said support for said magneto flywheel to divert EMI from said magneto and said wires to said ground, said first wire means further including a Lossy Sleeve Cover over said conductive shield means, to prevent radiation of said EMI carried by said wires and said shield;

a control box positioned on and grounded to said mounting structure;

connector means for introducing said first wire means into said control box, including means grounding said first conductive shield to said box to complete transfer of said EMI from said shield to said ground, said connector means connecting said plurality of wires to individual feed-through capacitor means for each wire to transfer said ignition current into said box and said EMI to ground, said ignition current inherently radiating EMI inside said box, said capacitor means being mounted inside and grounded to a wall of said box to disperse EMI transferred by said current flowing through said capacitor means and preventing flow of EMI outside of said box, back along said first wire means to magneto;

power pack means mounted in and grounded to said box to control said ignition current and inherently generating additional EMI inside said box;

second wire means including a plurality of wires connected to transmit ignition current from said individual capacitor means to said power pack means whereby said capacitors prevent re-radiation of said EMI generated by said power pack means back to the outside of said box;

ignition coil means mounted in and grounded to said box for generating high tension ignition current and inherently generating additional EMI;

third wire means including wires connected to transmit ignition current from said power pack means to the input of said ignition coil means, said wires inherently radiating additional EMI;

strap means mounted inside said box to hold said ignition coil means free from vibration to prevent sparking from connections and the resulting generation of EMI during operation of said coils;

resistance type high tension wire leads connected at one end to the output terminal of said ignition coil and psasing through an exit means from said box potentially inherently transmitting EMI out of said box, said exit means including inside grounding means on the inside wall of said box to ground said exit means inside said box to said wall, said exit means also including outside grounding means on the outside wall of said box to ground said high tension wire outside said box to said wall, whereby both said inside and said outside grounding means cooperate to prevent radiation of EMI from said box, said high tension wire further including a braided conductive shield covering said wire outside said box and being mounted to said outside grounding means to prevent said high tension wire from radiating EMI; and spark plug cap means for connecting said high tension wire to said spark plug cap of said engine, said cap means further including bonding means for preventing arcing generation of EMI and loss of spark due to separation of said lead and said spark plug cap, said bonding means maintaining ground contact between said shield and said cap to provide a ground path for any radiated EMI enclosed by said shield and cap.

2. The device of claim 1, wherein said control box has a single separate wire leading to ground.

3. The device of claim 1, wherein said control box is assembled from metal without the use of sheet metal screws.

4. The device of claim 1, wherein the metal at every ground contact is cleaned to bare metal using rotary action prior to use of said device.

5. The device of claim 1, wherein aluminum surfaces are treated to render the surface conductive and corrosion resistant.

6. The device of claim 1, wherein said control box includes a removable face having a total periphery metal-to-metal seal.

* * * * *